US006035668A

United States Patent [19]

Akopian

[11] Patent Number: 6,035,668

[45] Date of Patent: Mar. 14, 2000

[54] SHAPED, CIRCULAR WARP-KNIT CORD WITH LOCALIZED YARN DISTRIBUTION AND METHOD OF KNITTING THE SAME

[75] Inventor: Vladimir Akopian, Lincoln, R.I.

[73] Assignee: New England Overseas Corporation, Pawtucket, R.I.

[21] Appl. No.: 09/181,282

[22] Filed: Oct. 28, 1998

[51] Int. Cl.[7] ..... D04B 25/02

[52] U.S. Cl. ..... 66/81; 66/170; 66/192

[58] Field of Search ..... 66/190, 170, 192, 66/79, 80, 81, 94; 277/226, 227, 228, 229, 901; 174/35 GC

[56] References Cited

U.S. PATENT DOCUMENTS

| | | | |
|---|---|---|---|
| 239,287 | 3/1881 | Winans . | |
| 1,771,912 | 7/1930 | Blaisdell . | |
| 3,124,032 | 3/1964 | Webster et al. . | |
| 4,123,830 | 11/1978 | Matsuda et al. | 66/192 |
| 4,781,039 | 11/1988 | Ribarev et al. | 66/80 |
| 4,838,043 | 6/1989 | Jencks | 66/170 |
| 4,977,759 | 12/1990 | Jencks | 66/81 |
| 5,512,709 | 4/1996 | Jencks et al. | 174/35 GC |
| 5,603,514 | 2/1997 | Jencks et al. | 277/230 |

*Primary Examiner*—Danny Worrell
*Attorney, Agent, or Firm*—Barlow, Josephs & Holmes, Ltd.

[57] ABSTRACT

A shaped (multi-sided), circular warp-knit cord construction is provided with localized distributions of yarns on selected sides of the cord by selectively positioning and rotating yarns on a yarn guide. The yarns are positioned and rotated in such a manner that yarns of the same type of material are repeatedly located in the same knitting position or a closely spaced or adjacent position for each knitted course. Shaping of the cord is provided by selectively locating interlace yarns around the circumference of the cord construction. For example, four equally circumferentially spaced interlace yarns will form a square knit configuration having four distinct sides when viewed in cross-section. By selectively grouping and rotating yarns of the same type of material, yarns can be localized on a selected side or side of the cord construction.

12 Claims, 6 Drawing Sheets

SHAPED, CIRCULAR WARP-KNIT CORD WITH LOCALIZED YARN DISTRIBUTION AND METHOD OF KNITTING THE SAME

BACKGROUND AND SUMMARY OF THE INVENTION

The instant invention relates to circular warp-knit composite fabrics and cords, and more particularly to a shaped (multi-sided) warp-knit cord having selected types of yarn localized on selected side surfaces of the shaped cord to provide the selected side surfaces of the cord with particular surface characteristics attendant to the localized yarn materials.

Shaped cords, such as used for packing materials, have heretofore been known in the art. The term "shaped" as used within this specification is intended to encompass all types of cords, packings, etc. having a non-circular cross-section, and/or having at least one flat surface, such as in a square or triangular cross-section. With regard to known prior art, the U.S. Pat. No. 239,287to Winans ; Blaisdell U.S. Pat. No. 1,771,912; and Webster et al U.S. Pat. No. 3,124,032 represent different types of shaped packing materials. In the context of the invention, it is worthwhile to note that each of the packing materials described in these patents is formed by a braiding method and has uniform exterior surface properties on all sides. While these types of braid configurations are adequate for the intended purpose, it has been found that there is a need for a shaped, or multi-sided cord or packing material, wherein a single type of yarn material can be localized on a given side of the cord, while other yarn materials are localized on the other sides. For example in a packing cord, it would be advantageous to be able to provide a specialized Teflon yarn material on the inner side of the packing which engages the rotating shaft, and to utilize other less expensive materials on the other sides of the packing which do not contact the shaft. Such a configuration would utilize less of the more expensive Teflon materials and reduce the overall cost of such products. In general, braiding procedures utilize a single type of yarn wherein during braiding the yarns migrate around the periphery of the braid to provide a uniform distribution of yarns throughout the braid. Different types of yarns can be utilized in the braid. However, since the yarns are uniformly distributed during braiding, the exterior surface properties are uniform across all sides of the braid configuration. Because of the uniform yarn distribution in a braided material, the desired localized material configurations are impossible to achieve in a braiding method.

The instant invention provides the desired shaped cord construction having localized distributions of yarns on selected sides of the cord. The shaped cord of the present invention is formed using a circular warp-knitting method wherein selected types of yarns are grouped together and rotated in such a manner that yarns of the same type of material are repeatedly located in the same knitting position for each knitted course. Shaping of the cord is accomplished by selectively locating interlace yarns around the circumference of the cord construction. For example, four equally circumferentially spaced interlace yarns will form a square knit configuration having four distinct sides when viewed in cross-section.

Accordingly, among the objects of the instant invention are: the provision of a multi-sided (shaped) warp-knit cord wherein selected types of yarns are localized on selected sides of the shaped cord to provide one exterior surface of the cord with a particular type of yarn material and other exterior surfaces with another type of material; the provision of a square-shaped cord having a selected yarn type localized on one of the four sides of the cord; and the provision of a square-shaped cord having a selected yarn type localized on two opposing sides of the cord.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
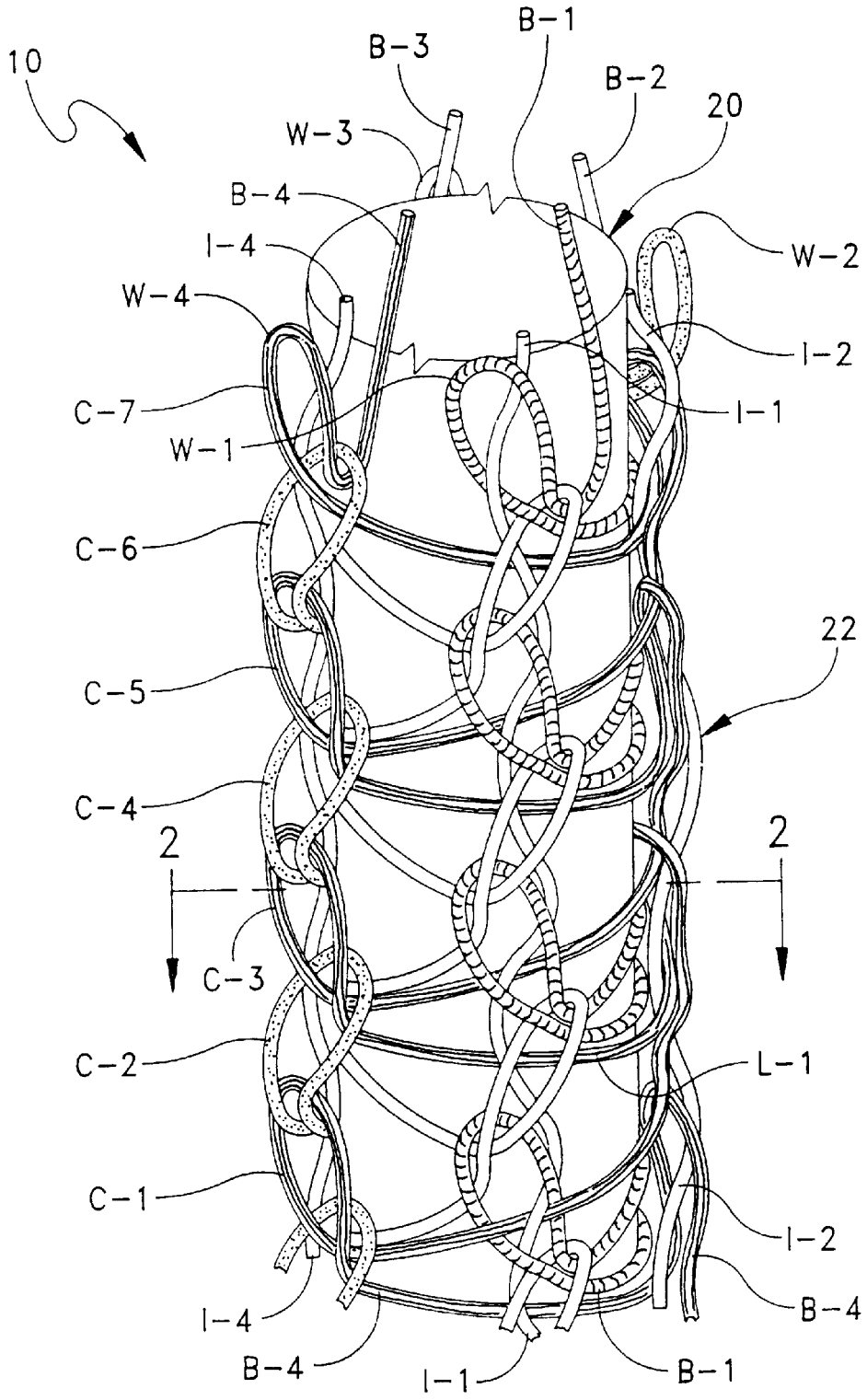
FIG. 1 (PRIOR ART)
FIG. 1 is a perspective view of a conventional square cross-section circular warp-knit composite cord.
Figure 2:
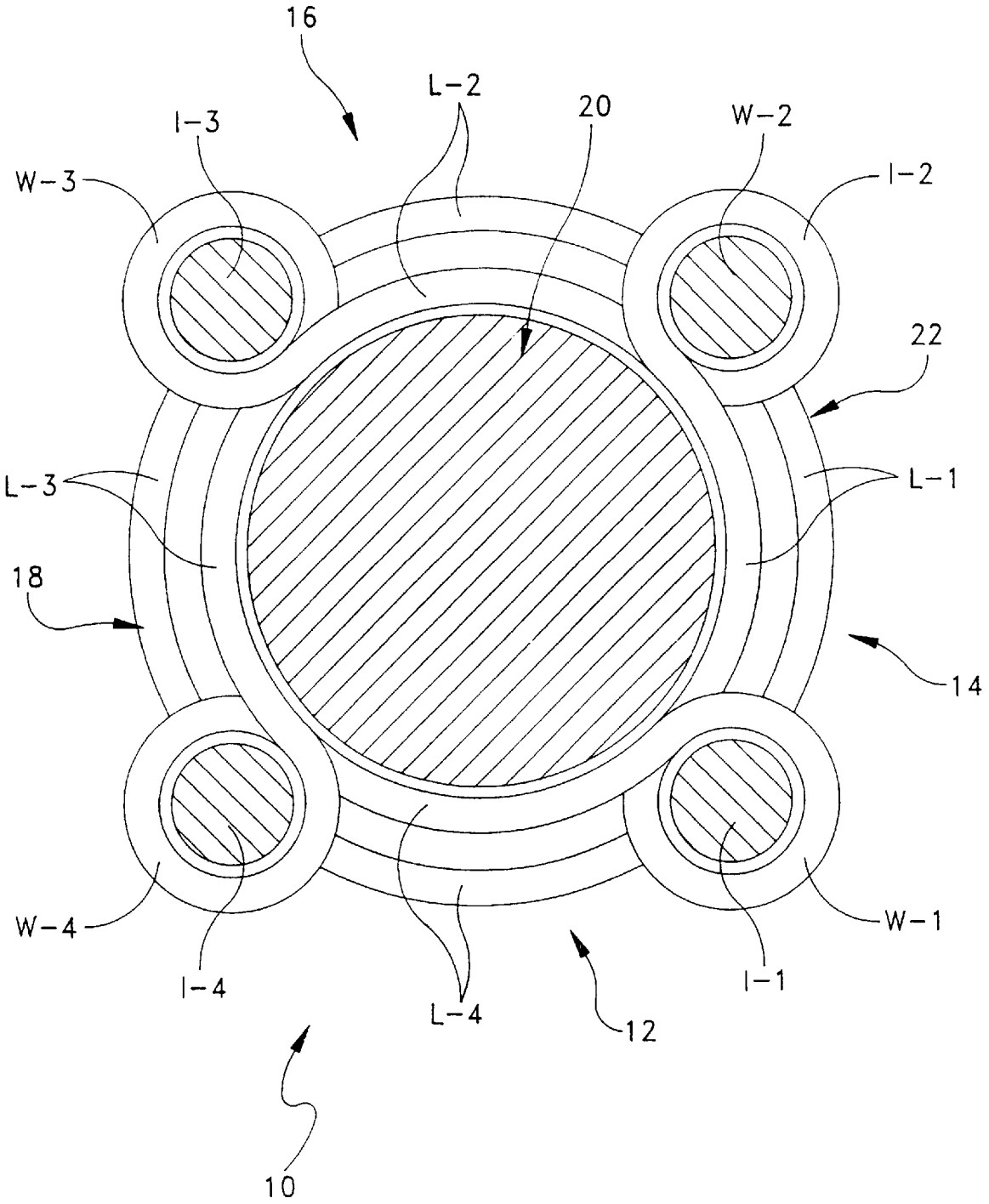
FIG. 2 is a cross-sectional view thereof as taken along line 2—2 of FIG. 1.

Referring now to the drawings, a conventional circular warp-knit composite cord is illustrated and generally indicated at 10 in FIGS. 1–2. Referring to the illustrated example as shown in FIGS. 1–2, a square, warp-knit cord construction 10 is provided having four distinct side surfaces generally indicated at 12, 14, 16, and 18 respectively (see FIG. 2)

The cord construction 10 comprises an inner longitudinal core element generally indicated at 20 and an outer tubular sheath generally indicated at 22. The inner core element 20 can comprise a variety of different types and constructions of varying material including bundles of straight yarns, knit bundles of yarns, knit or braided cords, etc. The particular types of yarns utilized in the core 20 can vary according to use of the shaped cord 10. In the present embodiment, the inner core 20 preferably comprises a bundle of longitudinally oriented yarns.

The outer sheath 22 is knit around the core 20 in a tubular configuration using a circular warp-knit method. The term "circular warp-knit", as its name implies, refers to a tubular warp-knit fabric which is formed by supplying a number of individual yarns to the needles of a circular knitting machine, and then knitting with all of the needles at the same time to produce a complete course at once. For the sake of clarity and illustration, the circular warp-knit materials illustrated in the drawing figures are shown in a simplified fashion, and specifically with fewer yarns than would be utilized in a preferred commercial product. The illustration in FIGS. 1 and 2 specifically show only four base yarns knitted on four (4) needles. The later embodiments to be described herein will be constructed using twelve (12) needles. It should be noted that the inventive concepts to be described herein cannot effectively be used with only four needles, and that the provision of description of the embodiment in FIGS. 1 and 2 is intended for a clear illustration and understanding of the general principles of circular warp knitting. More complex drawings with larger numbers of yarns would tend to be more confusing in a perspective view rather than more illustrative.

The circular warp-knit sheath 22, as shown in FIGS. 1 and 2, is generally knit from a plurality of base yarns B-1 through B-4. Shading has been added to the yarns B-1 through B-4 to help distinguish each from the other in the drawings. The illustrated circular warp-knit tube 14 has four wales, indicated at W-1 through W-4 circumferentially spaced around the tube 14. The base yarn needle loops form successive courses illustrated C-1 through C-7. The separate base yarns each form base yarn needle loops in corresponding wales W-1 through W-4 of course C-1 and form circular and diagonally extending laps generally indicated L-1 through L-4 extending between and interconnecting the circumferentially spaced wales of the course C-1 with opposite needle loops positioned in the opposite wales in the next successive course. Generally speaking, circular warp-knitting and the automatic knitting machines utilized for rapid warp-knitting of tubular structures as illustrated herein are well known in the art. In this regard, warp-knitting machines and specific knitting procedures which may be utilized for producing a circular warp-knit tube of the type referred to herein are further disclosed in detail in co-owned U.S. Patents to Jencks and Jencks et al U.S. Pat. Nos. 4,838,043, 4,977,759, 5,512,709 and 5,603,514, each of which is entirely incorporated herein by reference.

The warp-knit sheath 22 is further knit with a plurality of interlace yarns I-1 through I-4 which are respectively interlaced within the wales W-1 through W-4 of the structure 10. The interlace yarns I-1 through I-4 extend generally longitudinally in a zig-zag path along the corresponding wales W-1 through W-4 and are generally utilized to control the longitudinal stability of the circular warp-knit tube. The interlace yarns of the circular warp-knit are selectively positioned at predetermined locations within the knit so as to give the sheath a predetermined geometric configuration when knitted. In a preferred construction of 4, 8, 12, 16, 20, 24 knitting needles, four interlace yarns are arranged in a symmetrical square configuration to give the cord construction a generally square configuration. However, it is noted that movement of the four interlace to non-symmetrical locations in the knit would provide the sheath with other configurations, such as rectangular or trapezoidal. Similarly, the provision of only three interlace yarns would provide the sheath 22 with a triangular configuration. It is to be further understood that varied other geometric configurations are also possible within the scope of the invention.

Turning now to the inventive concepts, this type square cord 10 can be effectively used as a packing material wherein a section of the cord can be severed and wrapped end to end to form a "packing ring". As described in the background hereinabove, it is advantageous to be able to provide the inner side surface of the packing ring with a localized distribution of Teflon or other selected yarns so as to provide a low friction surface against the rotating shaft. While this example specifically refers to use of the shaped cord as a packing material, it is to be understood that this is a representative example only, and that there are other potential uses for shaped cords with localized yarn distributions.

Figure 3:
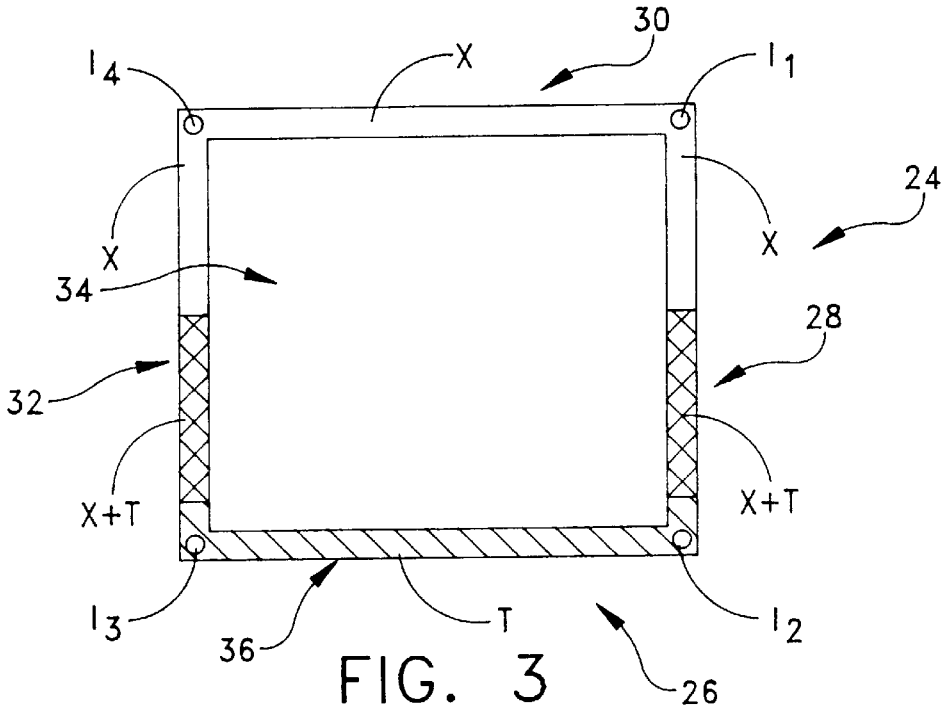
FIG. 3 is a schematic diagram of a first cord construction fabricated in accordance with the teachings of the present invention and showing a localized yarn distribution along a single outer side of the cord.

As will hereinafter be more fully described, the instant invention provides a shaped, circular, warp-knit composite cord having localized distributions of selected yarns on a selected side surfaces of the cord so as to provide the side surfaces with predetermined surface properties. The key feature of the present invention resides in a unique knitting method which permits the localization of a selected type of yarn on a selected side of the shaped cord to provide one surface of the cord with a particular type of yarn material and other surfaces with another type of material. Referring to FIG. 3 there is illustrated a shaped, circular warp-knit cord generally indicated at 24 having a square configuration with sides indicated at 26, 28, 30, 32 respectively. The cord 24 has a core 34 and an outer sheath 36, although it is to be understood that the cord 24 could be manufactured without the central core 34. Four interlace yarns $I_1$ through $I_4$ occupy the four corners of the square configuration. In accordance with the teaching of the present invention, base yarns of a first type T are localized on a single side surface 26 (single cross-hatched area) of the cord 24 while base yarns of a second type X are localized on the three remaining sides 28, 30, 32 (not cross-hatched). Overlapped areas of yarns X and T (double cross-hatched) are localized on opposing sides 28 and 32. The overlap results from a needle shift during knitting. In a packing material of the type described above, it is contemplated that the first type of base yarns (face yarns) T might comprise Teflon, Kevlar, graphite coated, etc. yarns while the second type of base yarns (backing yarns) x might comprise a low cost natural or synthetic fiber yarn (Teflon and Kevlar are registered trademarks of E.I. Du Pont De Nemours and Company). The localized use of the Teflon yarns would significantly reduce the material cost of producing the packing since the low friction materials are used only where necessary for proper function of the packing material, i.e. on the inner bearing surface 26.

Figure 4:
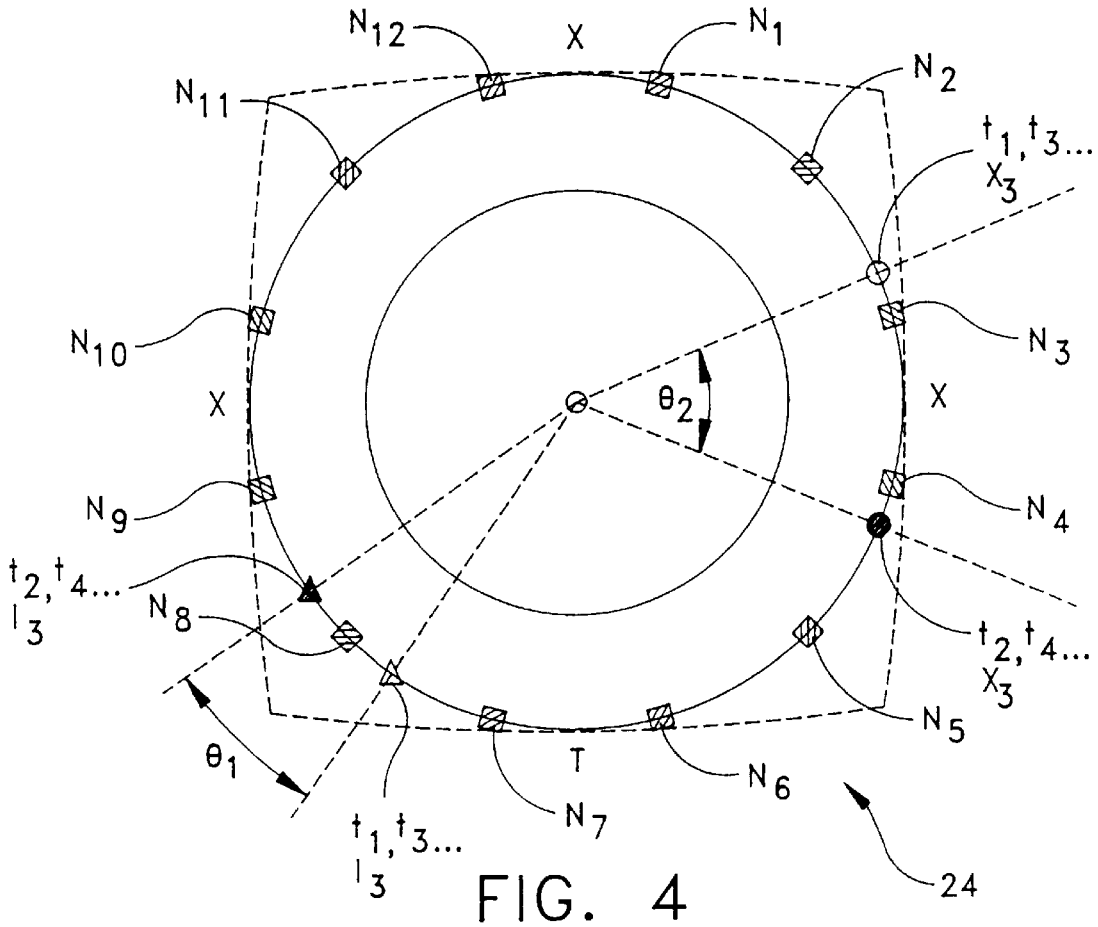
FIG. 4 is a rotation diagram of the knitting method used to knit the cord of FIG. 3 showing the placement patterns of the base yarns and interlace yarns, a single needle rotation (shift) of the base yarn guide, and the independent rotation of the interlace yarn guide during knitting thereof.
Figure 5:
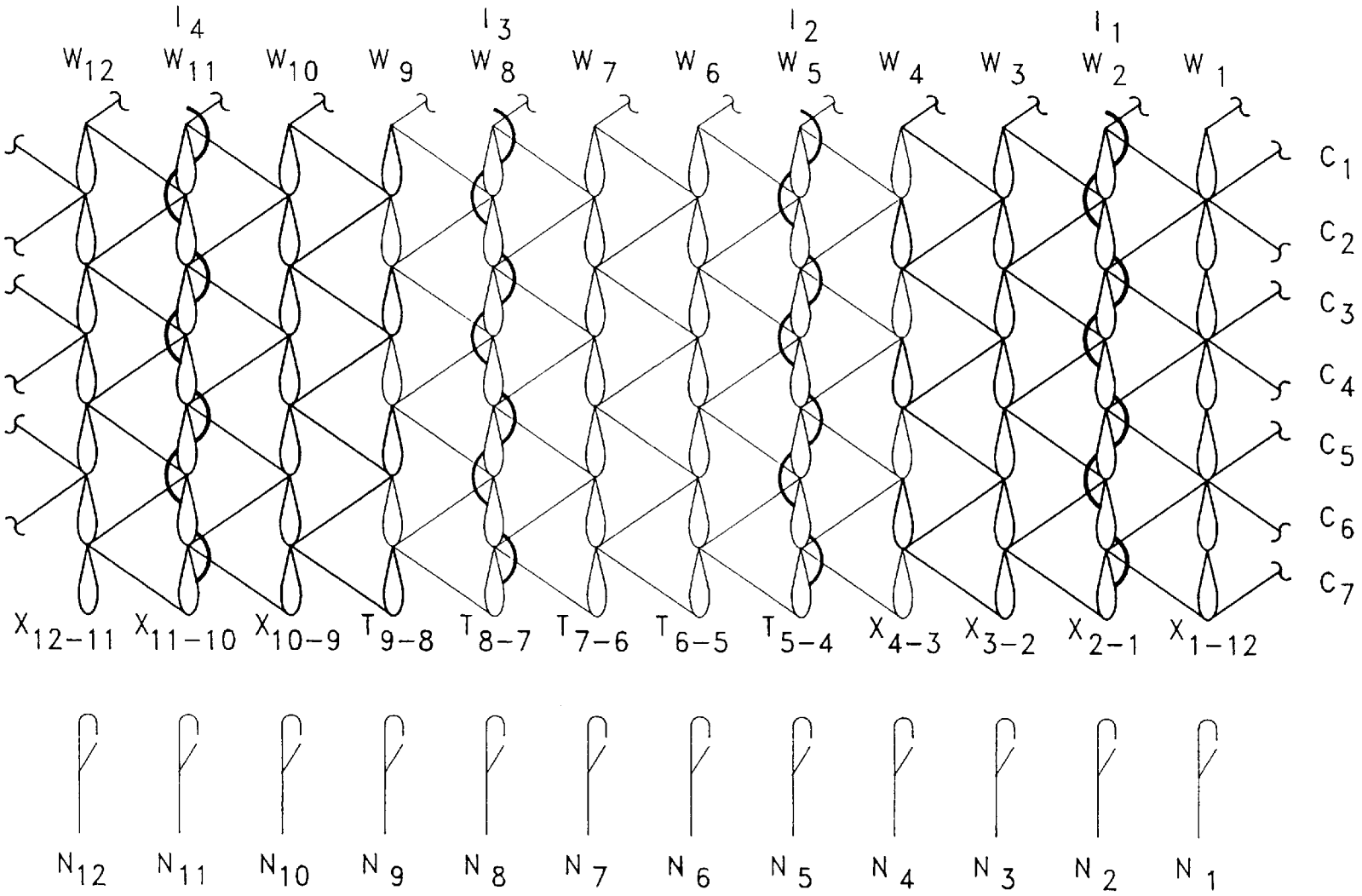
FIG. 5 is a schematic knit diagram thereof showing knitting of the loops of the base yarns and the crossover of yarns between the wales during the single needle shift rotation.

Turning to FIG. 4, the knit pattern utilized to provide this configuration is shown in schematic form. The cord 24 is preferably knit in a knitting machine using two reciprocating yarn guides (not shown) and a twelve (12) needle configuration, the needles being identified in the drawings as $N_1$ through $N_{12}$. For a description of the location and operation of the yarn guides in a circular warp-knitting machine, see reference numerals 22 and 51 in U.S. Pat. No. 4,977,759 which is fully incorporated herein by reference. The square shape of the resulting cord 24 is illustrated in broken line within the illustration. The needles N are physically represented by squares in the drawings. The four interlace yarns $I_1$ through $I_4$ are equally circumferentially spaced around a first yarn guide to coincide with needles $N_2$, $N_5$, $N_8$, and $N_{11}$ to form the corners of the cord 24. For purposes of the illustration, the interlace yarns I are represented by triangles. Only one interlace yarn $I_3$ is illustrated in FIG. 4 for purposes of clarity of the illustration. However, all four interlace yarns are illustrated in thick solid black lines in FIG. 5 with respect to their respective needle locations. FIG. 5 is a schematic view of the movement of the yarns between the needles during knitting, and shows the various courses and wales as they are formed during knitting. During knitting of the cord, the interlace yarn guide will repeatedly jog back and forth in a single needle shift so as to zig-zag the interlace the yarns back and forth through the respective needle at the corner position. The degree of rotation of the first yarn guide (carrying interlace yarns I) is represented by $\theta_1$ (about 20–30 degrees) with alternating timing positions indicated as $t_{1,3}\ldots$ and $t_{2,4}\ldots$. Following this example, interlace $I_3$ jogs back and forth between positions $I_3^{t1,3}\cdots$ (open triangle) and $I_3^{t2,4}\cdots$ (solid triangle). Referring to FIGS. 4 and 5, the knit cord 24 utilizes twelve base yarns equally circumferentially spaced around a second yarn guide to coincide with needles $N_1$ through $N_{12}$. To provide a localized distribution of T type yarns on a given side of the cord, the knit uses five (5) T type yarns (lighter lines in FIG. 5) $T_5$ through $T_9$ positioned on the second yarn guide to coincide with needles $N_5$ through $N_9$, and further uses seven (7) backing yarns (darker lines in FIG. 5) $X_1$ through $X_4$ and $X_{10}$ through $X_{12}$ positioned on the second yarn guide to coincide with needles $N_1$ through $N_4$ and $N_{10}$ through $N_{12}$. The yarns T and X are generally represented by circles in FIG. 4). The rotation of the second yarn guide (carrying base yarns T and X) is a single needle shift represented by $\theta_2$ (about 45 degrees) with alternating timing positions indicated as $t_{1,3}\ldots$ and $t_{2,4}\ldots$. Following this example, base yarn $X_3$ jogs back and forth between positions $X_3^{t1,3}\cdots$ (open circle) and $X_3^{t2,4}\cdots$ (solid circle). Referring to FIG. 5, movement of the yarns in the single needle shift is clearly illustrated. Each of the yarns is shaded in a different thickness to more clearly show the movement from one needle to the next. For example, yarn $X_3$ shifts back and forth between needles $N_3$ and $N_4$ forming alternating loops in wales $W_3$ and $W_4$. The knit creates a generally square configuration having single side formed from wales $W_5$–$W_8$ which is exclusively formed of yarns T. Wales $W_4$ and $W_9$ have alternating loops of yarns X and T forming a transition adjacent to the corners and the remaining wales $W_1$–$W_3$ and $W_{10}$–$W_{12}$ are formed exclusively of yarns X.

Figure 6:
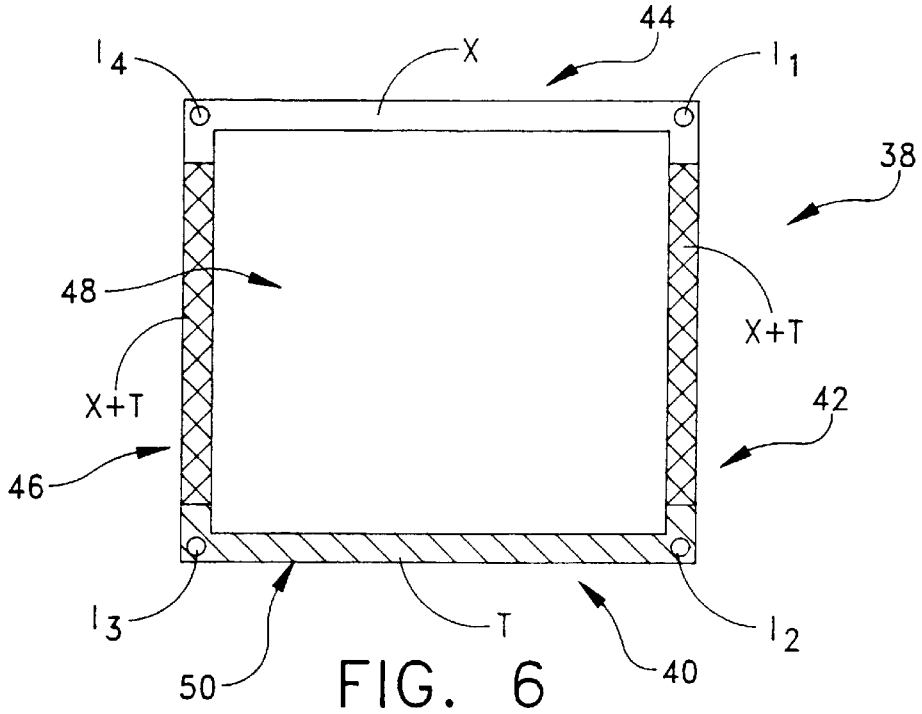
FIG. 6 is a schematic diagram of a another cord also showing localized yarn distribution along a single outer side of the cord.
Figure 7:
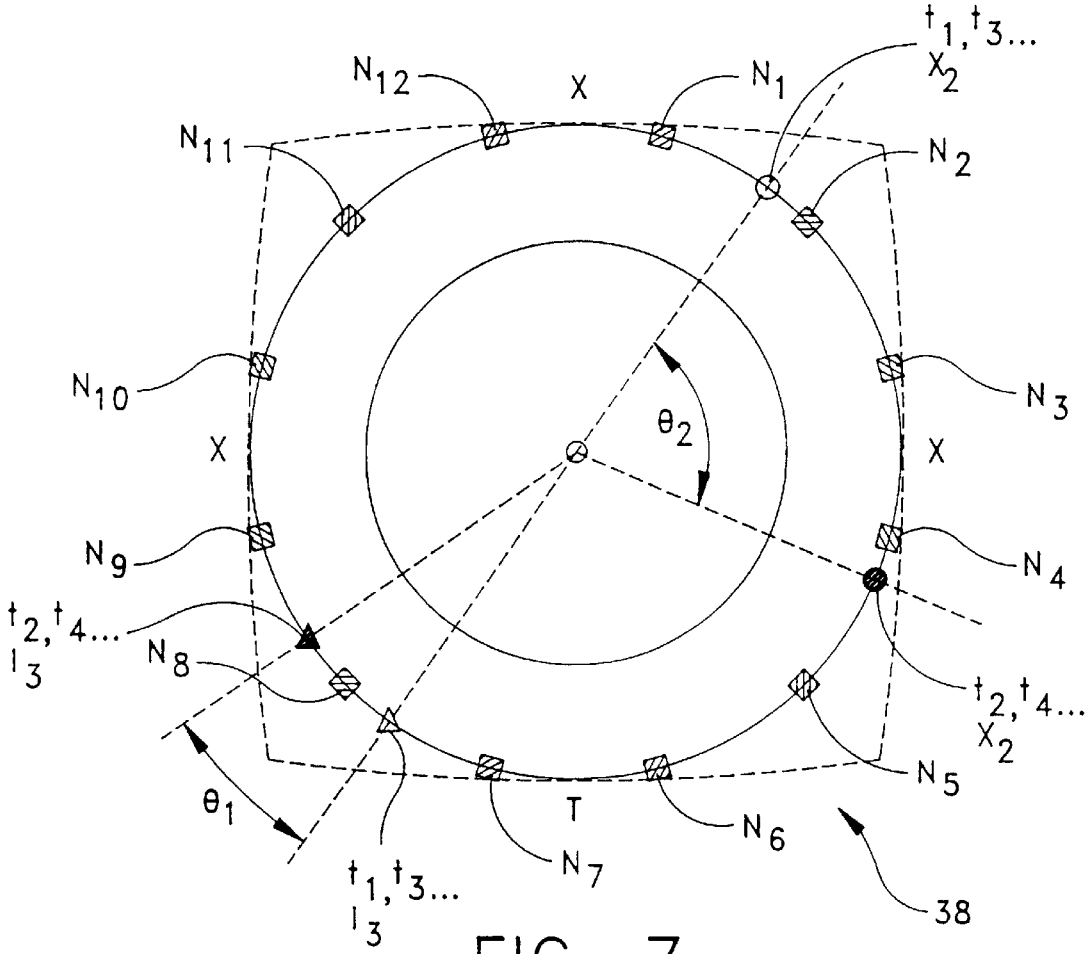
FIG. 7 is a rotation diagram of a second knitting method showing the placement patterns of the base yarns and interlace yarns, a two needle rotation (shift) of the base yarn guide and the independent rotation of the interlace yarn guide during knitting thereof.

Turning to FIGS. 6 and 7, there is illustrated another shaped circular warp-knit cord 38 also having a square configuration. The cord 38 has four sides 40, 42, 44, and 46 respectively, and includes a central core 48 and outer sheath 50. As in the previous embodiment, four interlace yarns $I_1$ through $I_4$ occupy the four corners of the square configuration. The resulting one-sided configuration of this cord 38 is similar to the previous configuration 24. However, the yarn configuration and knitting method used to achieve the configuration is slightly different. The knit pattern utilized to provide this configuration is shown in schematic rotation diagram in FIG. 7. The cord 38 is knit in a knitting machine using two reciprocating yarn guides (not shown) and a twelve (12) needle configuration identified in the drawings as $N_1$ through $N_{12}$. The square shape of the resulting cord 38 is illustrated in broken line within the illustration in FIG. 7. The needles N are physically represented by squares in the drawings. The four interlace yarns $I_1$ through $I_4$ are equally circumferentially spaced around a first yarn guide to coincide with needles $N_2$, $N_5$, $N_8$, and $N_{11}$ to form the corners of the cord. For purposes of the illustration, the interlace yarns I are represented by triangles. During knitting of the cord, the interlace yarn guide will repeatedly jog back and forth in a single needle shift so as to zig-zag the interlace the yarns back and forth through the respective needles at the corner positions. The degree of rotation of the first yarn guide (carrying interlace yarns I) is represented by $\theta_1$ (about 20–30 degrees) with alternating timing positions indicated as $t_{1,3}\ldots$ and $t_{2,4}\ldots$. Still referring to FIG. 7, the knit cord 38 utilizes twelve (12) base yarns equally circumferentially spaced around a second yarn guide to coincide with needles $N_1$ through $N_{12}$. To provide a localized distribution of T type yarns on side T 40 of the cord 38, the knit uses six (6) backing yarns $X_1$–$X_3$ and $X_{10}$–$X_{12}$ positioned on the second yarn guide to coincide with needles $N_1$–$N_3$ and $N_{10}$–$N_{12}$, and further uses six (6) T type yarns $T_4$ through $T_9$ positioned on the second yarn guide to coincide with needles $N_4$ through $N_9$. The yarns T and X are generally represented by circles in the drawings. The degree of rotation of the second yarn guide (carrying base yarns T and X) is represented by $\theta_2$ (about 90 degrees) with alternating timing positions indicated as $t_{1,3}\ldots$ and $t_{2,4}\ldots$. Following this example, base yarn $X_2$ jogs back and forth between positions $X_2^{t1,3}\cdots$ (open circle) and $T_1^{t2,4}\cdots$ (closed circle), the rotation of all other yarns being the same, but now shown. The combination of yarn position and rotation of the second yarn guide exclusively places base yarns T within wales $W_5$–$W_8$ to form side 40. Wales $W_3$–$W_4$ and $W_9$–$W_{10}$ have alternating loops of yarns X and T forming a transition at the corners and the remaining wales $W_1$–$W_2$ and $W_{11}$–$W_{12}$ are formed exclusively of yarns X.

Figure 8:
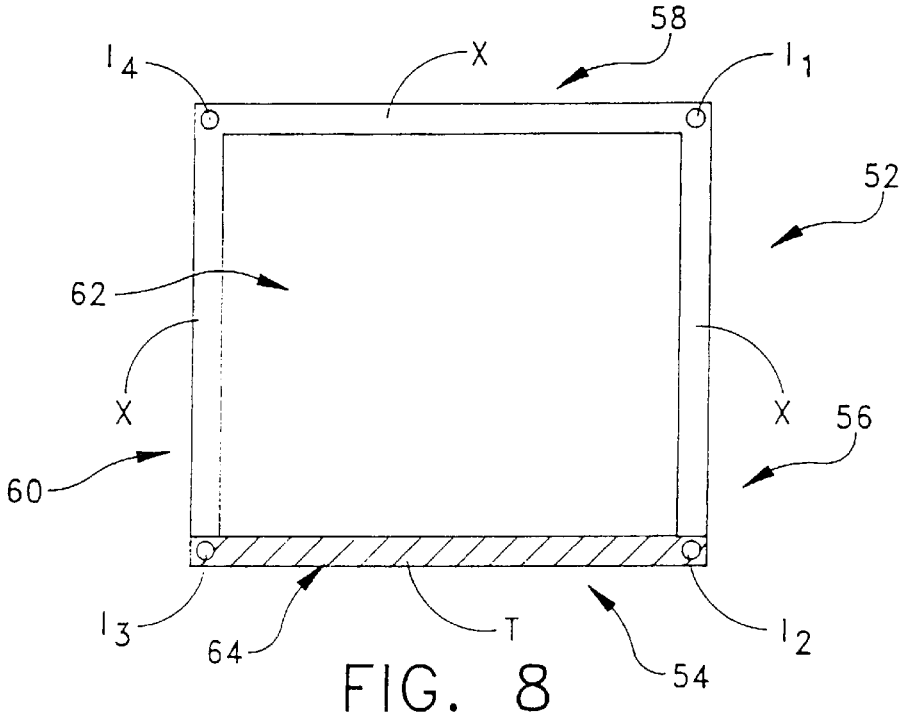
FIG. 8 is a schematic diagram of yet another cord also showing localized yarn distribution along a single outer side of the cord.
Figure 9:
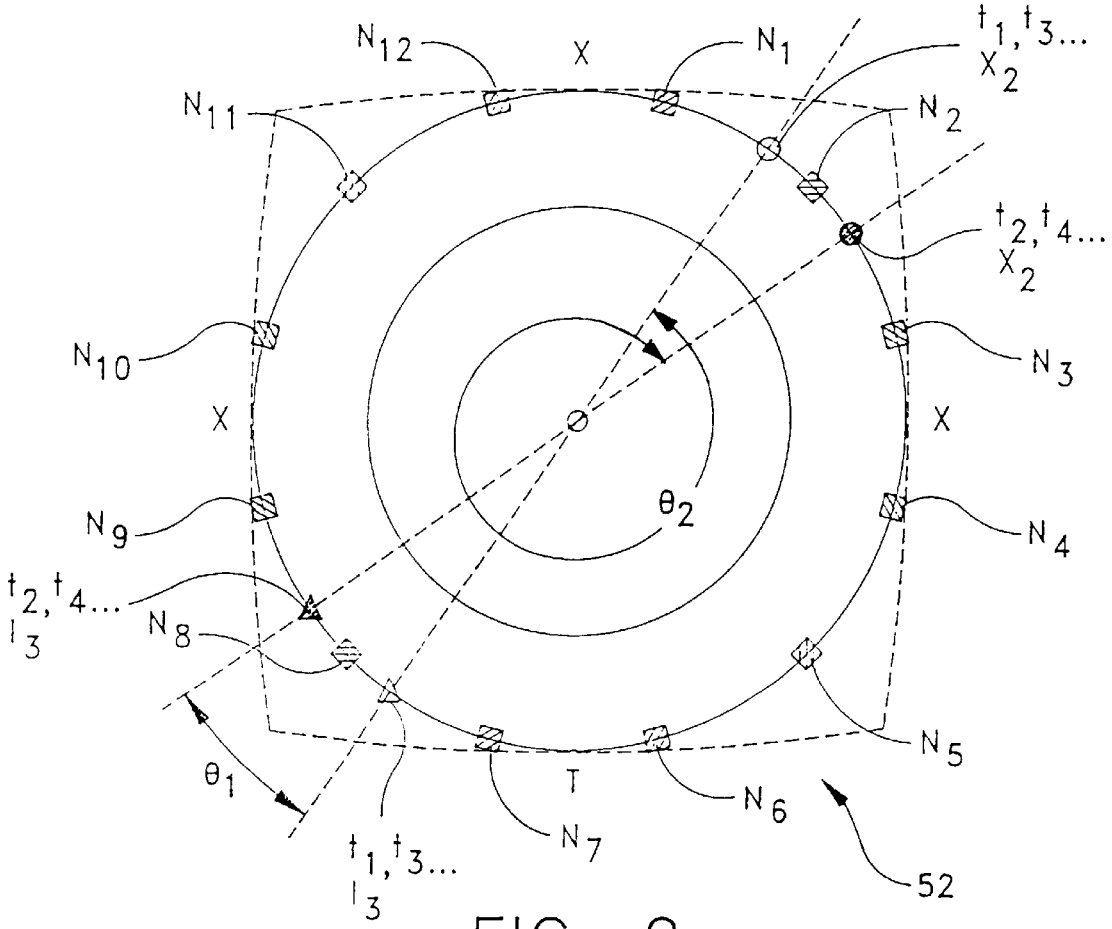
FIG. 9 is a rotation diagram of a third knitting method showing the placement patterns of the base yarns and interlace yarns, a thirteen needle rotation (shift) of the base yarn guide and the independent rotation of the interlace yarn guide during knitting thereof.

Turning to FIGS. 8 and 9, there is illustrated yet another shaped circular warp-knit cord 52 also having a square configuration. The cord 52 has four sides 54, 56, 58, and 60 respectively, and includes a central core 62 and outer sheath 64. As in the previous two embodiments, four interlace yarns $I_1$ through $I_4$ occupy the four corners of the square configuration. The resulting one-sided configuration of this cord is again the same as the previous configurations. However, the knitting method used to achieve the configuration is also different from the two previous methods. The knit pattern utilized to provide this configuration is shown in schematic rotation diagram in FIG. 9. The cord 52 is knit in a knitting machine using two reciprocating yarn guides (not shown) and a twelve (12) needle configuration identified in the drawings as $N_1$ through $N_{12}$. The square shape of the resulting cord 52 is illustrated in broken line within the illustration in FIG. 9. The needles N are physically represented by squares in the drawings. The four interlace yarns $I_1$ through $I_4$ are equally circumferentially spaced around a first yarn guide to coincide with needles $N_2$, $N_5$, $N_8$, and $N_{11}$ to form the corners of the cord. For purposes of the illustration, the interlace yarns I are represented by triangles. During knitting of the cord, the interlace yarn guide will repeatedly jog back and forth in a single needle shift so as to zig-zag the interlace the yarns back and forth through the respective needles at the corner positions. The degree of rotation of the first yarn guide (carrying interlace yarns I) is represented by $\theta_1$ (about 20–30 degrees) with alternating timing positions indicated as $t_{1,3}\ldots$ and $t_{2,4}\ldots$. Still referring to FIG. 9, the knit cord 52 utilizes twelve (12) base yarns equally circumferentially spaced around a second yarn guide to coincide with needles $N_1$ through $N_{12}$. To provide a localized distribution of T type yarns on side T 54 of the cord 52, the knit uses 8 (8) backing yarns $X_1$–$X_4$ and $X_9$–$X_{12}$ positioned on the second yarn guide to coincide with needles $N_1$–$N_4$ and $N_9$–$N_{12}$, and further uses four (4) T type yarns $T_5$ through $T_9$ positioned on the second yarn guide to coincide with needles $N_5$ through $N_9$. The yarns T and X are generally represented by circles in the drawings. The degree of rotation of the second yarn guide (carrying base yarns T and X) is represented by $\theta_2$ (about 375 degrees) with alternating timing positions indicated as $t_{1,3} \ldots$ and $t_{2,4} \ldots$. Following this example, base yarn $X_2$ jogs back and forth between positions $X_2^{t1,3} \cdots$ (open circle) and $T_1^{t2,4} \cdots$ (closed circle), all other yarns being the same, but not shown. The combination of yarn position and rotation of the second yarn guide exclusively places base yarns T within wales $W_5$–$W_8$ to form side 54. Wales $W_1$–$W_4$ and $W_9$–$W_{12}$ are formed exclusively of yarns X with no transition wales at the corners. As indicated above, the rotation of the second yarn guide generally places the base knitting yarns on the same knitting needles for each knitting course, circling the yarns back and forth around the core through the respective knitting needles.

While there are specific illustrations of methodology and yarn arrangement herein described, it is to be understood that the same inventive principles can be applied to achieve various geometric shape cord configurations including but not limited to triangular, pentagonal, octagonal, varied yarn localization on single or multiple sides of the resulting cord shape, and various combinations of core and outer sheath materials. It is also noted that any of the cords herein described can be formed in a tubular configuration, without a central core. It is still further noted that when knitting using 16 or more needles, tapering of the corners may be needed to produce planar side surface. Tapering is intended to mean to addition of interlace yarns at the corners and at positions adjacent to the corners to fill out the corner areas. For example, in a 20 needles knit, a group of four interlace yarns are used at each corner interlace position to bulk up the corner, and single interlace yarns are positioned directly to the sides of the corners to fill in the area between the corner and the center of the respective face.

It can therefore be seen that the present invention provides a unique shaped cord construction having selected yarn types localized on selected side portions of the cord. The circular warp-knitting methods utilized to construct the cords provide for high-speed knitting and production of these types of cords while also providing the unique ability to shape the cord, and provide desired surface characteristics on selected sides thereof. The number of needles may vary from a few to many with various needle shifts from one to a full circle on the total number of needles in use to achieve various end products. In accordance with the teachings of the invention, these types of cords have significant value in the marketplace, and are believed to represent a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A shaped circular warp-knit cord construction comprising:

a shaped circular warp-knit tube formed from a plurality of base yarns and a plurality of interlace yarns, said warp-knit tube having an exterior side surface, said interlace yarns being selectively distributed and positioned within said warp-knit tube so as to define a longitudinally extending, flattened, side surface portion of said exterior side surface, said plurality of base yarns comprising a plurality of yarns of a first type that are localized on said flattened side surface portion, and a plurality of yarns of a second type that are distributed throughout remaining side surface portions of the exterior side surface of said warp-knit tube, said localized distribution of said base yarns of said first type on said flattened side surface portion providing said flattened side surface portion with surface characteristics attendant to said yarns of said first type, said plurality of base yarns being selectively positioned at predetermined circumferential knitting positions on a rotating yarn guide, said yarns of said first type being grouped together in adjacent relation in circumferential knitting positions corresponding to said flattened side surface portion of said warp-knit tube, said rotating yarn guide being reciprocated during knitting of the tube so as to repeatedly locate each of said base yarns in a predetermined knitting position for each knitted course and to thereby localize each of said yarns of said first type on said flattened side surface portion of said tube, and to localize each of said yarns of said second type on said other remaining side surface portions of said tube.

2. The shaped circular warp-knit cord construction of claim 1 further comprising a longitudinal core element positioned within said warp-knit tube.

3. The shaped circular warp-knit cord construction of claim 1 wherein said warp-knit tube is knitted in a square configuration using four interlace yarns and having four flattened side surface portions.

4. The shaped circular warp-knit cord construction of claim 2 wherein said warp-knit tube is knitted in a square configuration using four interlace yarns and having four flattened side surface portions.

5. The shaped circular warp-knit cord construction of claim 1 wherein each of said plurality of yarns of said first type comprises a yarn having a predetermined coefficient of friction thereby providing said flattened side surface portion with said predetermined coefficient of friction.

6. The shaped circular warp-knit cord construction of claim 2 wherein each of said plurality of yarns of said first type comprises a yarn having a predetermined coefficient of friction thereby providing said flattened side surface portion with said predetermined coefficient of friction.

7. The shaped circular warp-knit cord construction of claim 3 wherein each of said plurality of yarns of said first type comprises a yarn having a predetermined coefficient of friction thereby providing said flattened side surface portion with said predetermined coefficient of friction.

8. The shaped circular warp-knit cord construction of claim 4 wherein each of said plurality of yarns of said first type comprises a yarn having a low coefficient of friction thereby providing said flattened side surface portion with a low coefficient of friction.

9. A method of forming a shaped, circular warp knit cord construction utilizing a circular, warp-knitting machine having a first reciprocating yarn guide for guiding base yarns into the needles, and a second reciprocating yarn guide for guiding interlace yarns into the needles, said method comprising the steps of:

positioning a plurality of interlace yarns at predetermined circumferential knitting positions around the second yarn guide, said interlace yarns being selectively spaced and positioned to define a longitudinally extending, flattened side surface portion on said cord construction;

positioning a plurality of base yarns at predetermined circumferential locations around the first yarn guide, said plurality base yarns comprising a plurality of yarns of a first type and a plurality of yarns of a second type, said plurality of yarns of said first type being grouped together in adjacent circumferential knitting positions corresponding to said flattened side surface portion of said cord construction, said plurality of yarns of said second type occupying other selected circumferential knitting positions; and knitting said base yarns together in successive courses while interlacing said interlace yarns within said base yarns to form said cord construction having said longitudinally extending, flattened side surface portion, said step of knitting including the step of repeatedly reciprocating said first yarn guide so as to repeatedly locate each of said base yarns in a predetermined knitting position for each knitted course and to thereby localize each of said yarns of said first type on said flattened side surface portion of said tube and to localize each of said yarns of said second type on other side surface portions of said cord construction.

10. The method of claim 9 further comprising the step of feeding a longitudinal core element within the center of said yarn guides wherein said knitted cord construction is knit around said longitudinal core element.

11. The method of claim 9 wherein said step of providing said interlace yarns comprises providing four equally spaced interlace positions to define a square cord configuration and four flattened side surface portions.

12. The method of claim 11 wherein base yarns of said first type are positioned as a group on the first yarn guide generally between two of said interlace positions on said second yarn guide, and further wherein said base yarns of said second type are provided in a plurality of other positions, said first yarn guide being reciprocated to repeatedly place said base yarns in the same circumferential knitting position for each knitted course, said knitting arrangement localizing said plurality of base yarns of the first type on said flattened side surface portion of the knitted cord construction while said plurality of base yarns of the second type are located on the remaining three sides of the cord construction.

* * * * *